US005419633A

United States Patent [19]

Lorenzetti et al.

[11] Patent Number: 5,419,633

[45] Date of Patent: May 30, 1995

[54] PADDLE MIXER WITH MIXING DRUM MOUNTED ON TRANSPORTABLE FRAME HAVING PADDLES WITH RUBBER SCRAPING ELEMENTS

[75] Inventors: Patrizio Lorenzetti, Colle Val D'Elsa; Giampiero Strada, Ponte A Bozzone; Fabrizio Papini, Poggibonsi, all of Italy

[73] Assignee: Imer International S.p.A., Poggibonsi, Italy

[21] Appl. No.: 279,437

[22] Filed: Jul. 25, 1994

[30] Foreign Application Priority Data

Apr. 14, 1994 [IT] Italy ..... FI94A0065

[51] Int. Cl.[6] ..... B28C 5/16; B01F 7/20

[52] U.S. Cl. ..... 366/40; 366/65; 366/67; 366/192; 366/312; 366/314

[58] Field of Search ..... 366/26, 40, 52, 64–67, 366/96–98, 189, 192, 193, 194–196, 309, 312, 313, 314

[56] References Cited

U.S. PATENT DOCUMENTS

| | | | |
|---|---|---|---|
| 3,211,436 | 10/1965 | Butterfield | 366/67 |
| 3,980,282 | 9/1976 | Burch et al. | 366/314 X |
| 4,165,185 | 8/1979 | Fejmert | 366/65 |
| 4,192,615 | 3/1980 | Fortunski et al. | 366/65 |
| 4,478,515 | 10/1984 | Tobin | 366/67 |
| 4,506,984 | 3/1985 | Strehlow | 366/67 X |

FOREIGN PATENT DOCUMENTS

| | | | |
|---|---|---|---|
| 1369180 | 6/1964 | France | 366/314 |
| 1280116 | 10/1968 | Germany | 366/52 |
| 56-46891 | 11/1981 | Japan | 366/65 |
| 81535 | 4/1956 | Netherlands | 366/65 |
| 1037221 | 7/1966 | United Kingdom | 366/65 |
| 1037222 | 7/1966 | United Kingdom | 366/40 |

*Primary Examiner*—David A. Scherbel
*Assistant Examiner*—Charles Cooley
*Attorney, Agent, or Firm*—McGlew and Tuttle

[57] ABSTRACT

Improved paddle mixer, including a stationary drum solid to a support frame, with a vertical shaft engaged with a motor-reducer unit and provided with a plurality of transverse arms to each of which at least a paddle is fixedly or otherwise rotatively connected, wherein each of the paddles, being fixed with respect to the relevant support arms, is made up of two like plates disposed at the free end of the corresponding arm and between which a rubber element is interposed so that, by the rotation of the shaft, that is, during the blending of the materials introduced inside the drum, the rubber element provides for scraping the side or respectively bottom wall of the drum.

9 Claims, 8 Drawing Sheets

PADDLE MIXER WITH MIXING DRUM MOUNTED ON TRANSPORTABLE FRAME HAVING PADDLES WITH RUBBER SCRAPING ELEMENTS

FIELD OF THE INVENTION

The present invention refers to an improved paddle mixer for dry or wet powdery materials possibly having fine granulometry such as gypsum, mortars, plasters, paving foundation and synthetic resins.

BACKGROUND OF THE INVENTION

Mixers are known to attain dry mixtures of powdery materials as well as homogeneous slurries of such mixtures with a suitable liquid.

Also known is that, in its basic construction, a traditional mixer consits of a substantially cylindrical container or drum inside which a shaft is disposed for engagement with a motor-reducer and provided with one or more transversal arms to each of which a paddle is connected fixedly or otherwise rotatively for rotation about an axis parallel to the same drive shaft. The term "paddle" herein referring both to an element intended to operate the proper mixing, and an element intended to scrape the bottom or the inner wall of the drum. The drum is provided with a loading hopper allowing the introduction from above of the materials to be mixed, and with an outlet mouth having a manually operated opening/closing gate. The output of the mixture from the drum usually occurs with the mixer paddles being in motion to ease the discharge thereof.

However, experience has shown that the known mixers exhibit some drawbacks, among which: a poor self-cleaning of the inner walls and of the bottom of the drum; a reduced ability of the mixture-discharging gate to provide sealing especially with respect to liquids; an insufficient distribution of the liquid over the materials to be mixed; the absence of safety measures for the introduction of materials into the drum when the latter is made accessible.

SUMMARY AND OBJECTS OF THE INVENTION

The main object of the present invention is to overcome the above drawbacks and provide some improvements as far the operation, reliability and safety of the paddle mixers are concerned.

This result has been achieved, according to the invention, by adopting the idea of making an improved paddle mixer, comprising a stationary drum within which a vertical shaft is disposed for engagement with a motor-reducer unit and provided with a plurality of transverse arms to each of which at least a paddle is connected fixedly or otherwise rotatively for rotation thereof about an axis inclined with respect to that of the shaft, the drum exhibiting an overhanging mouth for loading the materials to be mixed and an underlying mouth for discharging the mixture, the latter mouth being provided with a manually operated opening/closing gate, wherein provision is made for:—means for cutting off the supply of electrical power to the motor-reducer unit upon allowed access to the loading mouth of the drum-;—means for rain-like spreading the mixing liquid over the materials being introduced inside the drum;—means for self-cleaning the inner and bottom walls of the drum during the preparation of the mixture;—means for tightly sealing the opening/closing gate of the discharge mouth of the drum.

The avantages obtained from the present invention lie essentially in that it is possible to carry out the most suitable mixing of the materials being introduced inside the drum and the self-cleaning of same drum thanks to the combined action of the paddles, of the means for spreading the mixing liquid and the means for scraping the inner and bottom walls of the drum; that it is possible to introduce inside the drum the material to be mixed under the safest conditions, owing to the action of said protection means; that it is possible to ensure the maximum hydraulic seal of the opening/closing gate of the loading mouth of the drum; that a mixer according to the invention is relatively simple to build and reliable even after a prolonged service life.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE PREFERRED EMBODIMENT

Figure 1:
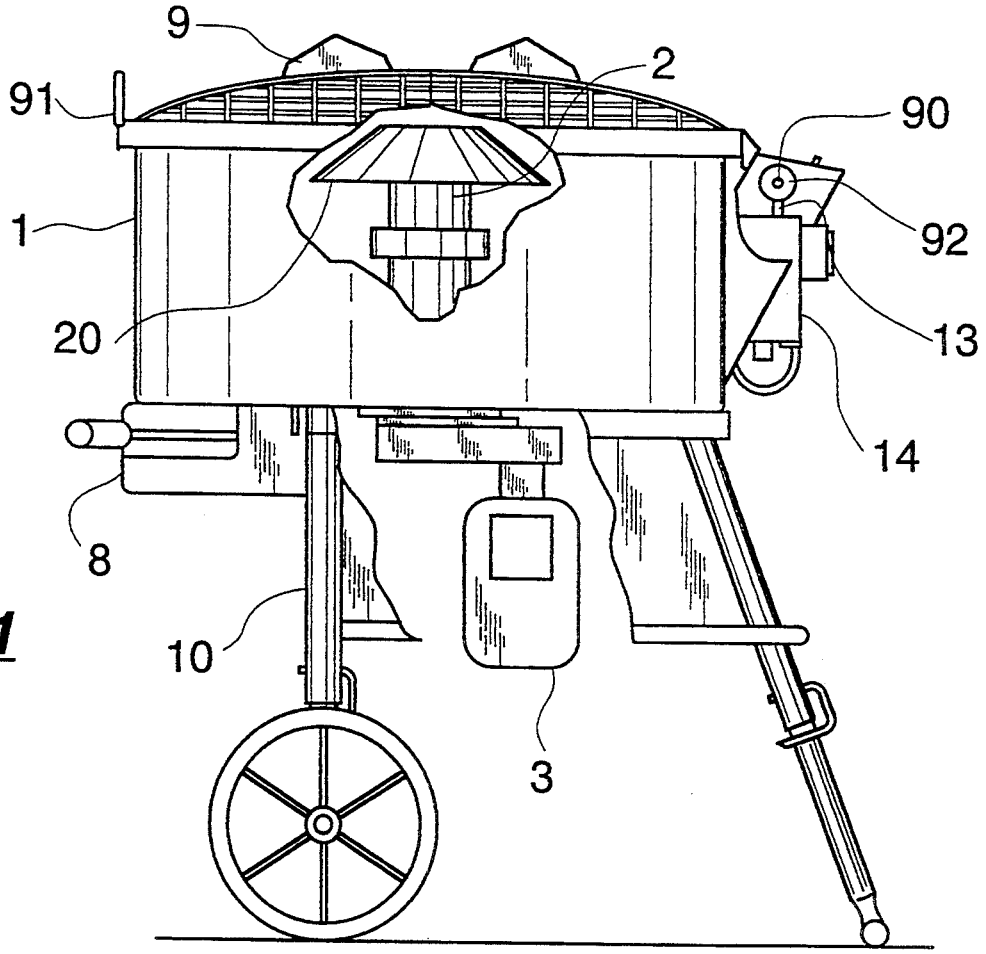
FIG. 1 is a side view partially in section of an improved paddle mixer according to the invention, in which all the paddles are rigidly connected to the respective support arms.
Figure 2:
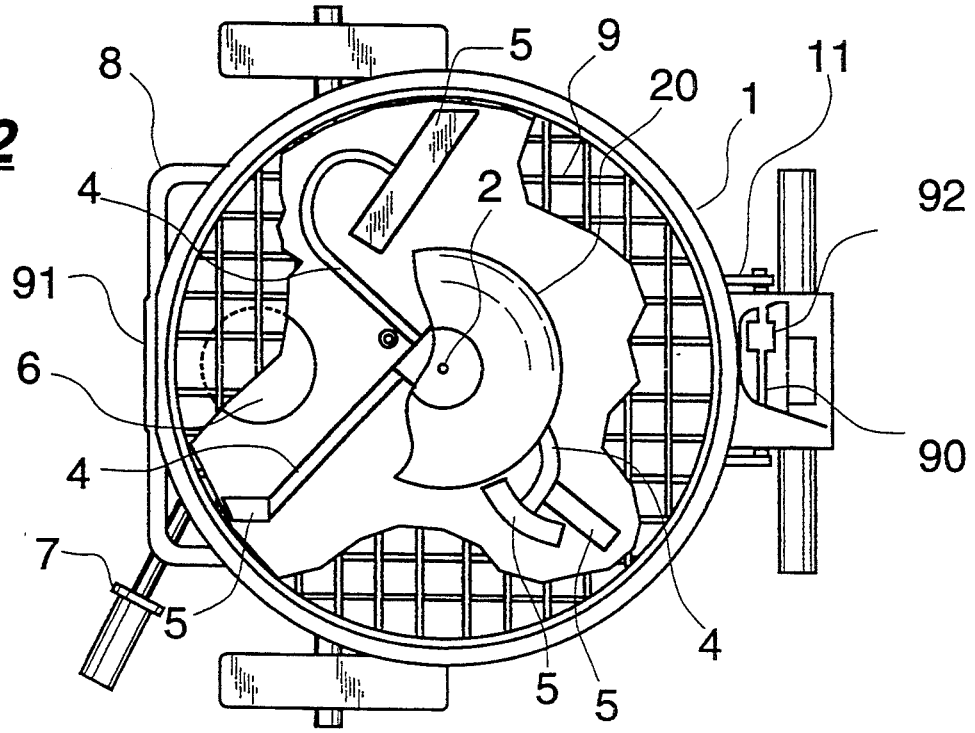
FIG. 2 is a plan view of the mixer of FIG. 1.
Figure 3:
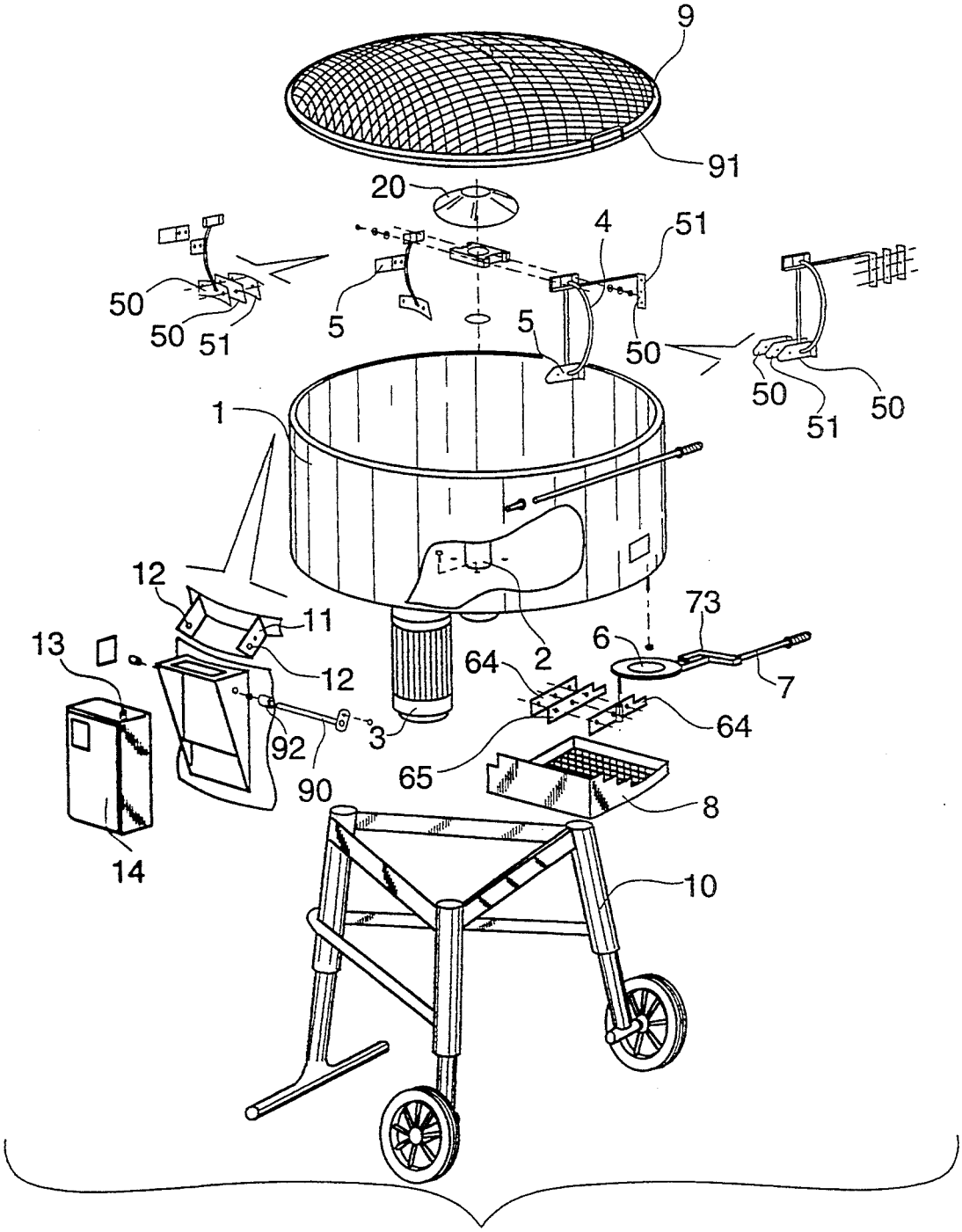
FIG. 3 is an exploded perspective view of the mixer of FIG. 1.
Figure 4:
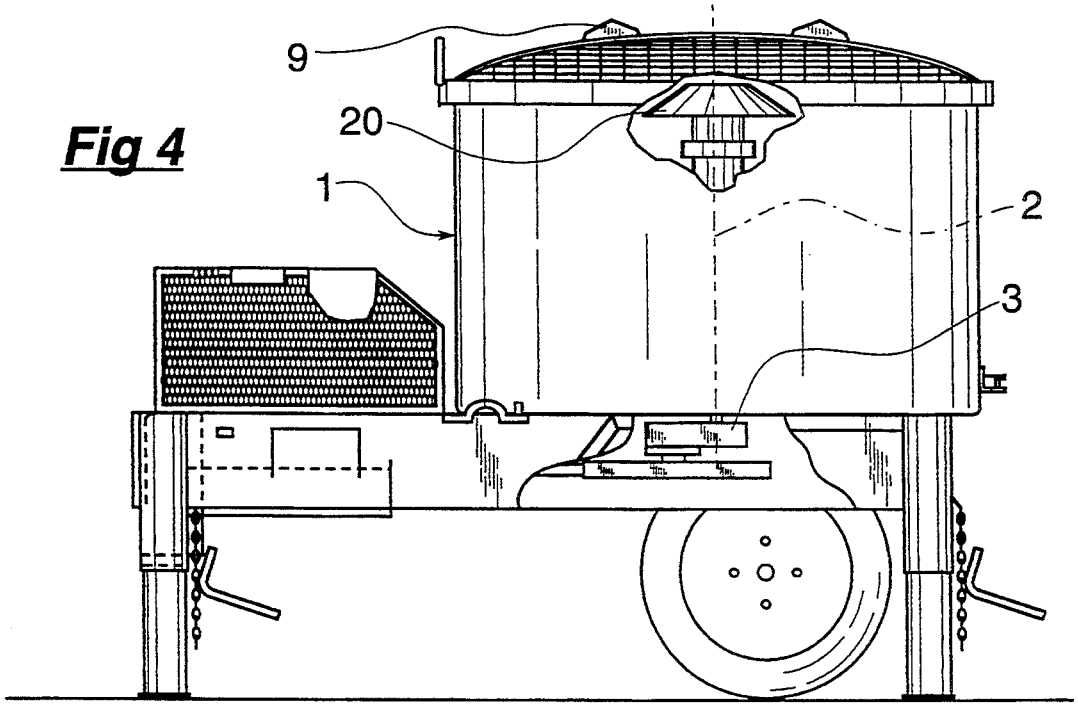
FIG. 4 is a side view partially in section of an improved mixer according to the invention, with a group of paddles fixed to the respective support arms and a group of paddles rotating about an axis parallel to that of the output shaft of the motor-reducer unit.

Reduced to its basic structure and with reference to the figures of the attached drawings, an improved paddle mixer comprises a stationary drum (mixing drum) (1) solid (connected rigidly) to a support frame (10) and inside which a vertical shaft (2) is connected to a motor-reducer unit (3) and provided with a plurality of transerse arms (4) to each of which at least a paddle (5) is fixedly connected. The drum has on top a mouth for loading the materials to be mixed and at the bottom a mixture discharging mouth provided with a corresponding horizontal opening/closing gate (6) engaged to a corresponding lever (7) to allow for the manual operation thereof. Disposed below said gate (6) is a corresponding protective grate (8).

According to the invention, each of said paddles (5) is made up of two like plates (50) disposed at the free end of the corresponding arm (4), and between which a corresponding rubber element (51) is interposed so that, upon rotation of the shaft (2), that is, during the blending of the materials introduced inside the drum (1), the same rubber element (51) provides for scraping the side or respectively bottom wall of the drum. In this way, the formation of lumps of dry mortar is avoided, while achieving the maximum homogeneity of the mixture due to the cooperation between the central high or low paddles (5) and the peripheral ones, so that the thus obtained mixture may be used as such to feed the known per se mortar-injecting devices. This construction allows also a rapid replacement of the rubber elements (51) when they are worn out.

According to the invention, provision is made for a second grate (9), disposed on top of the loading mouth of the drum (1) coaxially thereto and connected to the outer side wall of same drum (1) by a horizontal pivot (90) passing through two coaxial eyelets (12) of a fork-like bracket (11) solid to the grate (9), so as to enable the rotation thereof—about the axis of pivot (90) to allow, respectively, prevent, the access to said loading mouth of the drum (1)—by means of a handle (91) fixed to the grate (9) on the side diametrically opposite to pivot (90): said pivot (90) being provided with an annular cam (92) intended to operate the opening, respectively, the closing of the electrical contacts of a vertically sliding switch (13) connected to the electrical control panel (14) of the motor-reducer unit (3) so as to power off the motor in case the grate (9) is lifted by the operator, that is, under the condition in which the drum (1) is accessible.

According to the invention, said shaft (2) is provided on top with an element (20) of substantially truncated cone shape and coaxial to the same shaft (2), which is disposed below the mouth-piece of a pipe (15) for the admission of the liquid to be used for the mixing, so as to allow same liquid to be spread from above in a rain-like fashion over the materials to be mixed, through the effect of its falling on the element (20) and fragmentation into drops. In this way, the thus treated materials result properly and homogeneously mixed.

Figure 10:
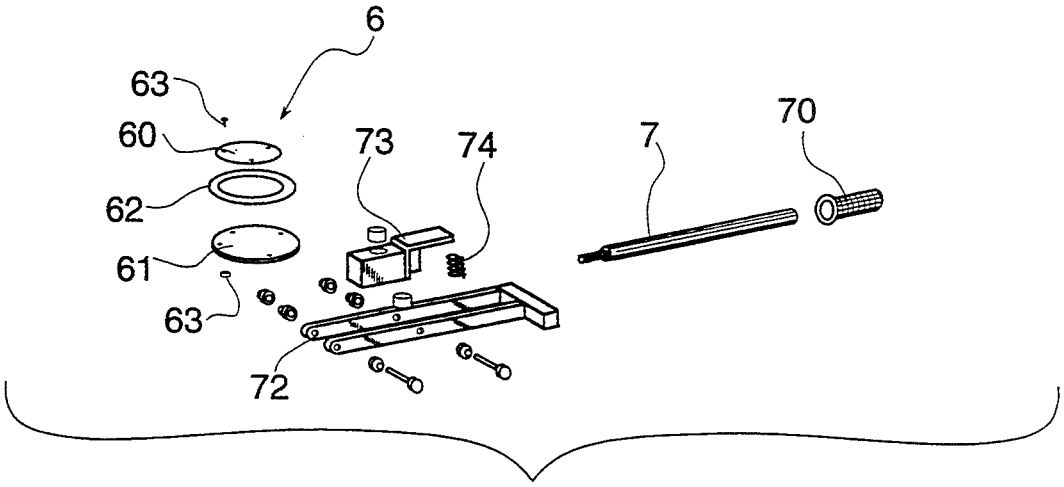
FIG. 10 is an exploded perspective view of the closing/opening gate of the discharging mouth of the drum of a mixer according to the invention.

According to the invention, said gate (6) is made up of two horizontal, coaxial, facing plates (60, 61) (see FIG. 10) between which an annular rubber gasket (62) is retained by screw means (63): the gate (6) being operable by a lever (7) which is connected, on the opposite side of the respective handle (70), to a fork-shaped bracket (72) which supports a gate (6)-bearing member (73) provided with an antagonist spring (74) having vertical axis (74), so as to allow the vertical elastic compression of the gate (6) against the lower edge of the discharging mouth of the drum (1) and, thereby, ensuring the hydraulic seal thereof.

Advantageously, according to the invention, said gate (6) is provided at the bottom with a paddle consisting of two like plates (64) between which a rubber element (65) is interposed to scrape the lower surface of the grate (68) whenever the opening of the discharging mouth of the drum (1) is operated, so as to avoid the formation of dry lumps of the agglomerates being produced.

Figure 11:
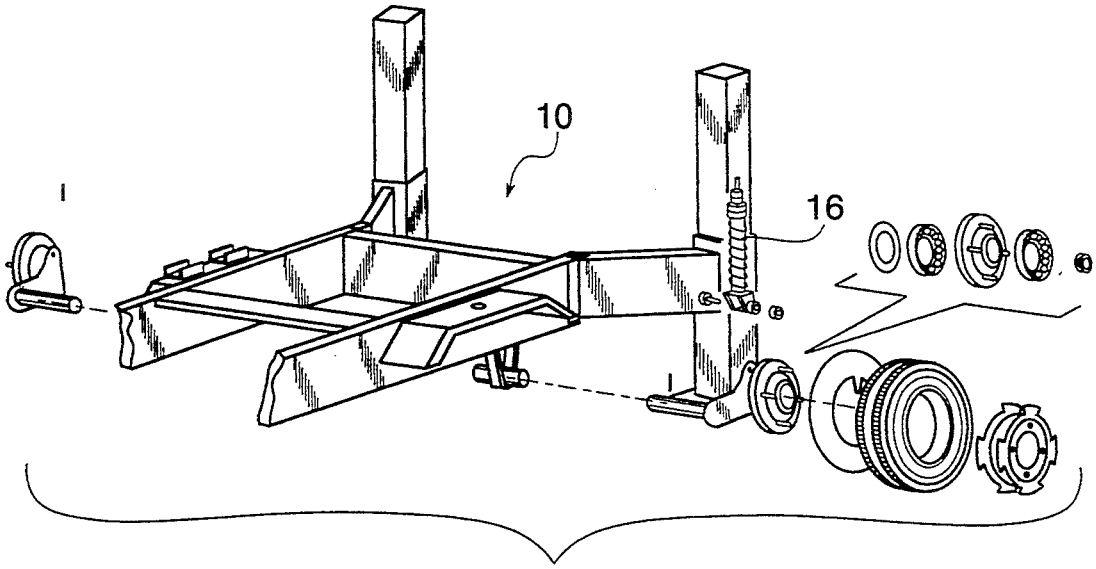
FIG. 11 shows the detail of the support frame of the mixers of FIGS. 4 and 7.

Advantageously, according to the invention and with reference to FIG. 11 of the attached drawings, said frame (10) for supporting the drum (1) is provided with dampers (16) to absorb shocks deriving from towing by known per se road transportation vehicles.

Figure 5A:
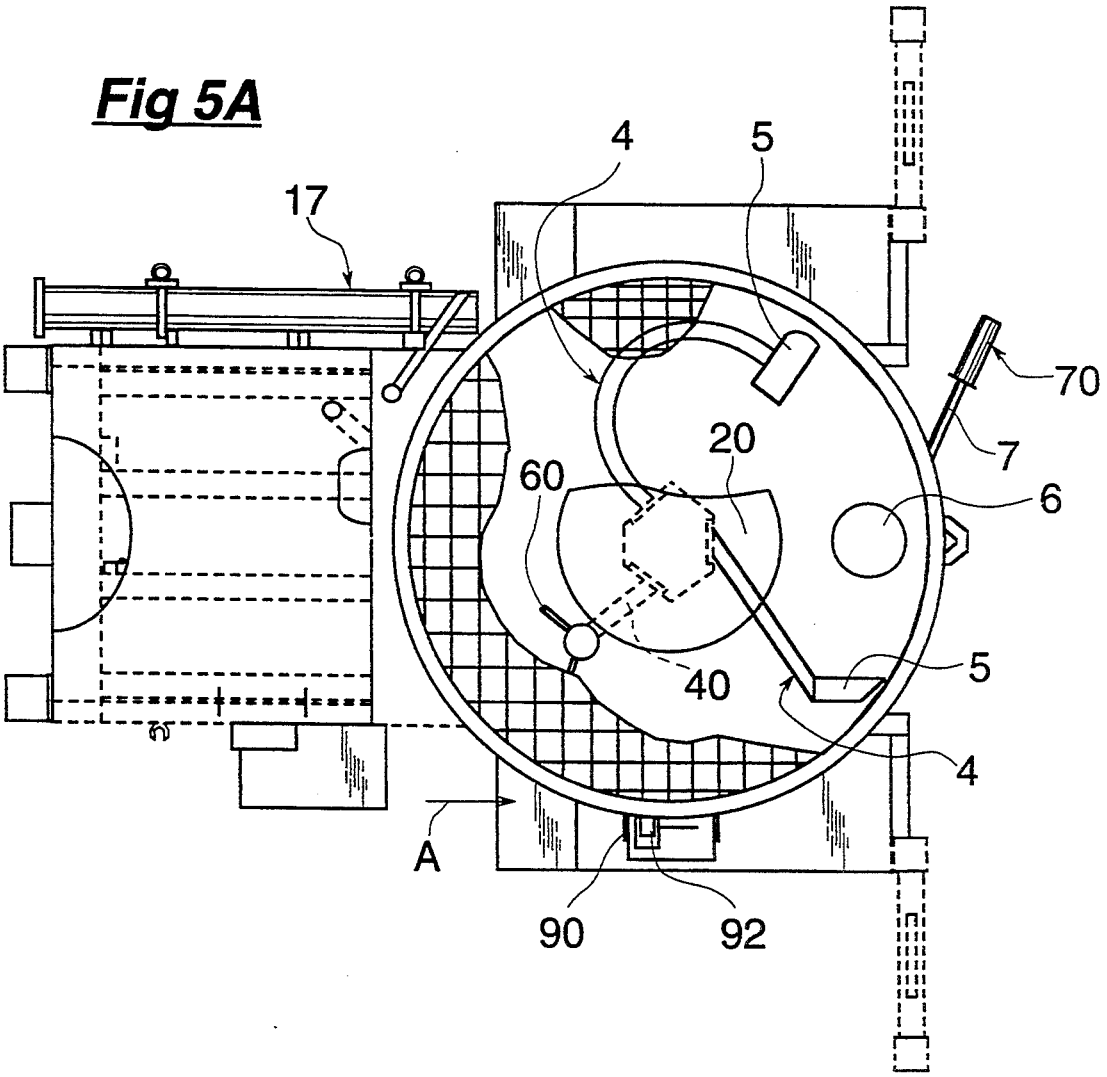
FIG. 5A is a plan view of the mixer of FIG. 4.
Figure 5B:
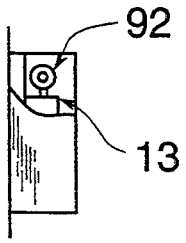
FIG. 5B is a view taken from A of FIG. 5A.
Figure 6:
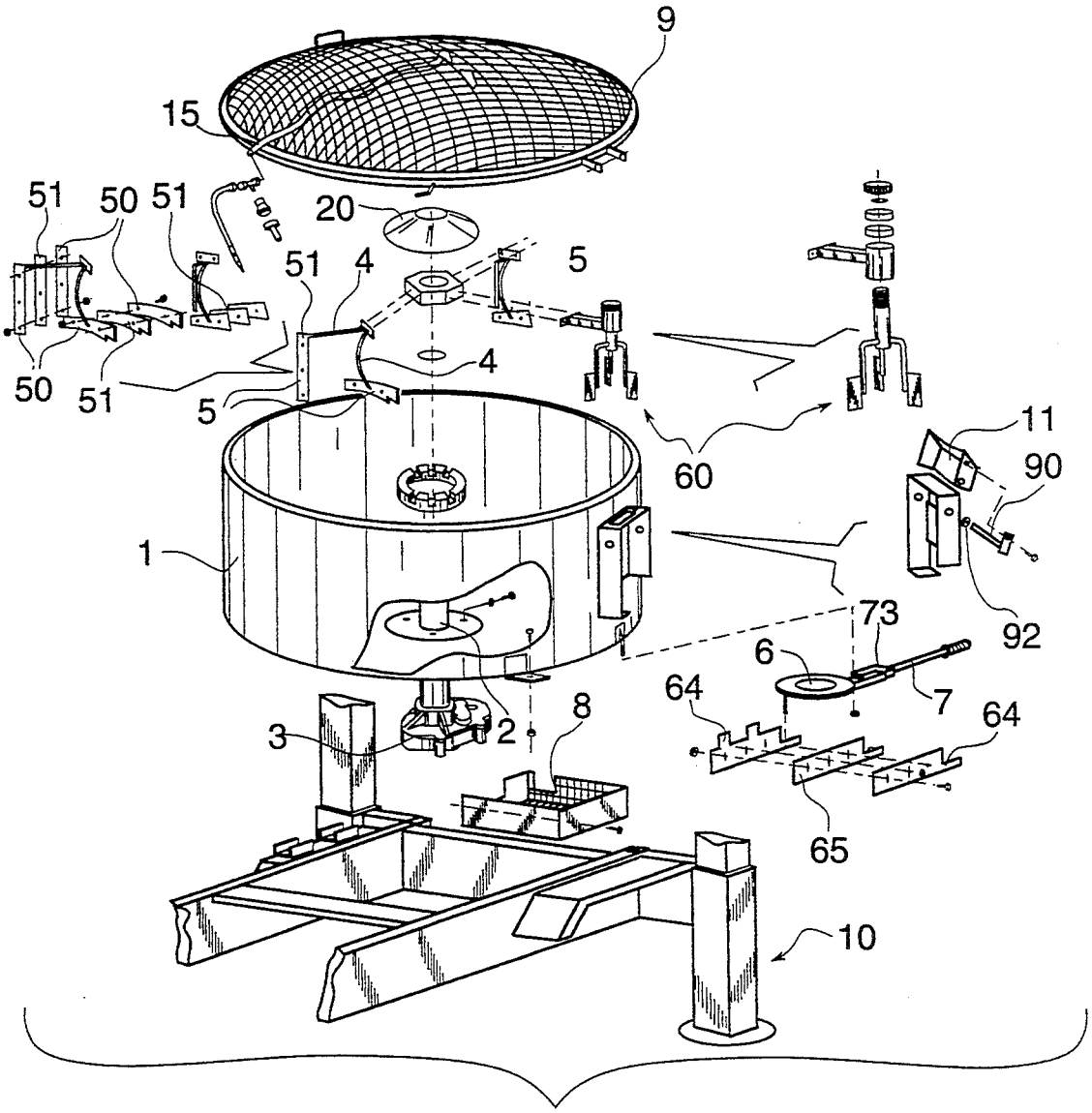
FIG. 6 is an exploded perspective view of the mixer of FIG. 4.
Figure 8:
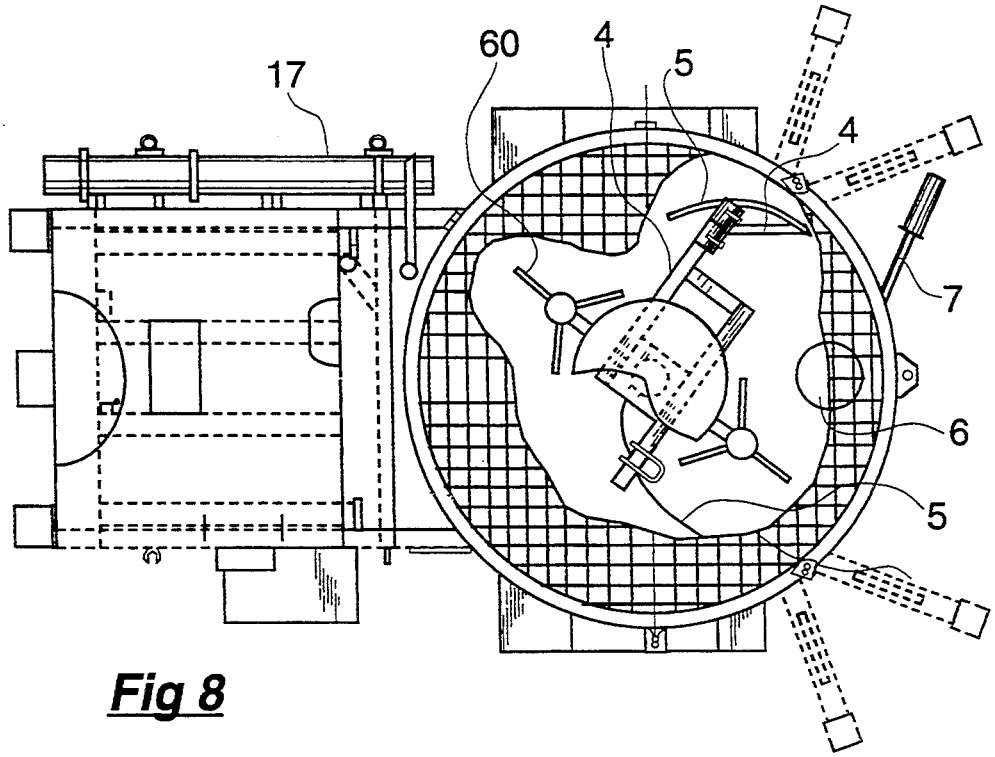
FIG. 8 is a plan view of the mixer of FIG. 7.

Moreover, according to the invention and with reference to FIGS. 5A and 8 of the attached drawings, said frame (10) is advantageously provided laterally with a lifting jack (17) to achieve the correct positioning thereof in the construction site.

As illustrated in the figures of the attached drawings, the above described means are applicable both to mixers of the type having paddles (5) rigidly connected to the respective support arms (4), and mixers of the type in which, in addition to the latter paddles, other paddles (60) are also provided, rotating about an axis transverse to a corresponding support arm (40) which is, in turn, driven into rotation by the shaft (2).

Figure 7:
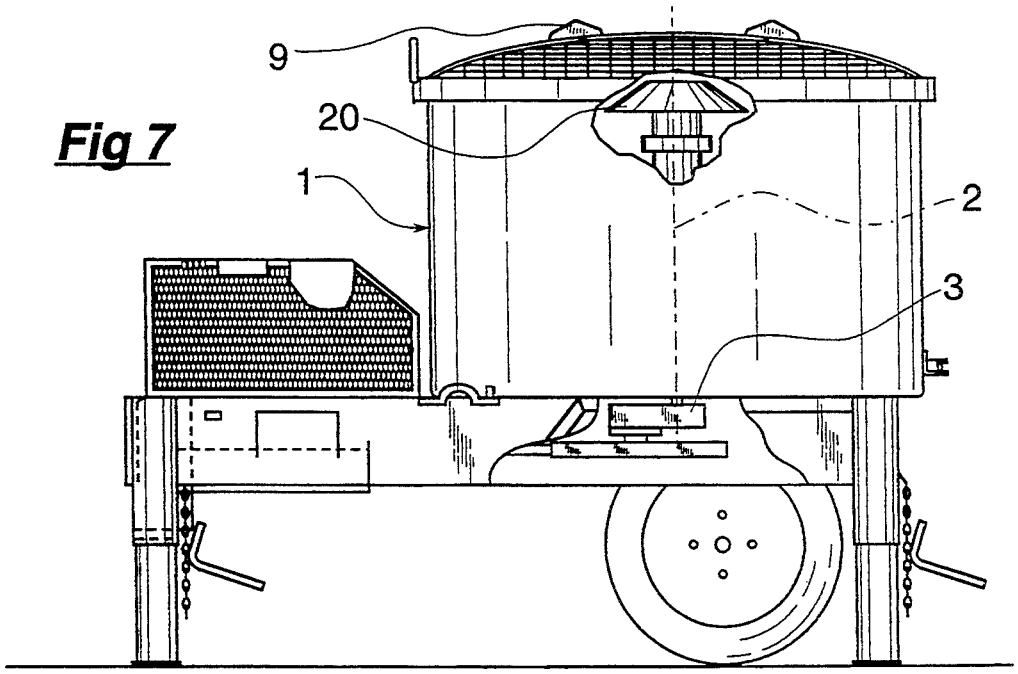
FIG. 7 is a side view partially in section of an improved mixer according to the invention, with a group of paddles fixed to respective support arms and two groups of rotary paddles.
Figure 9:
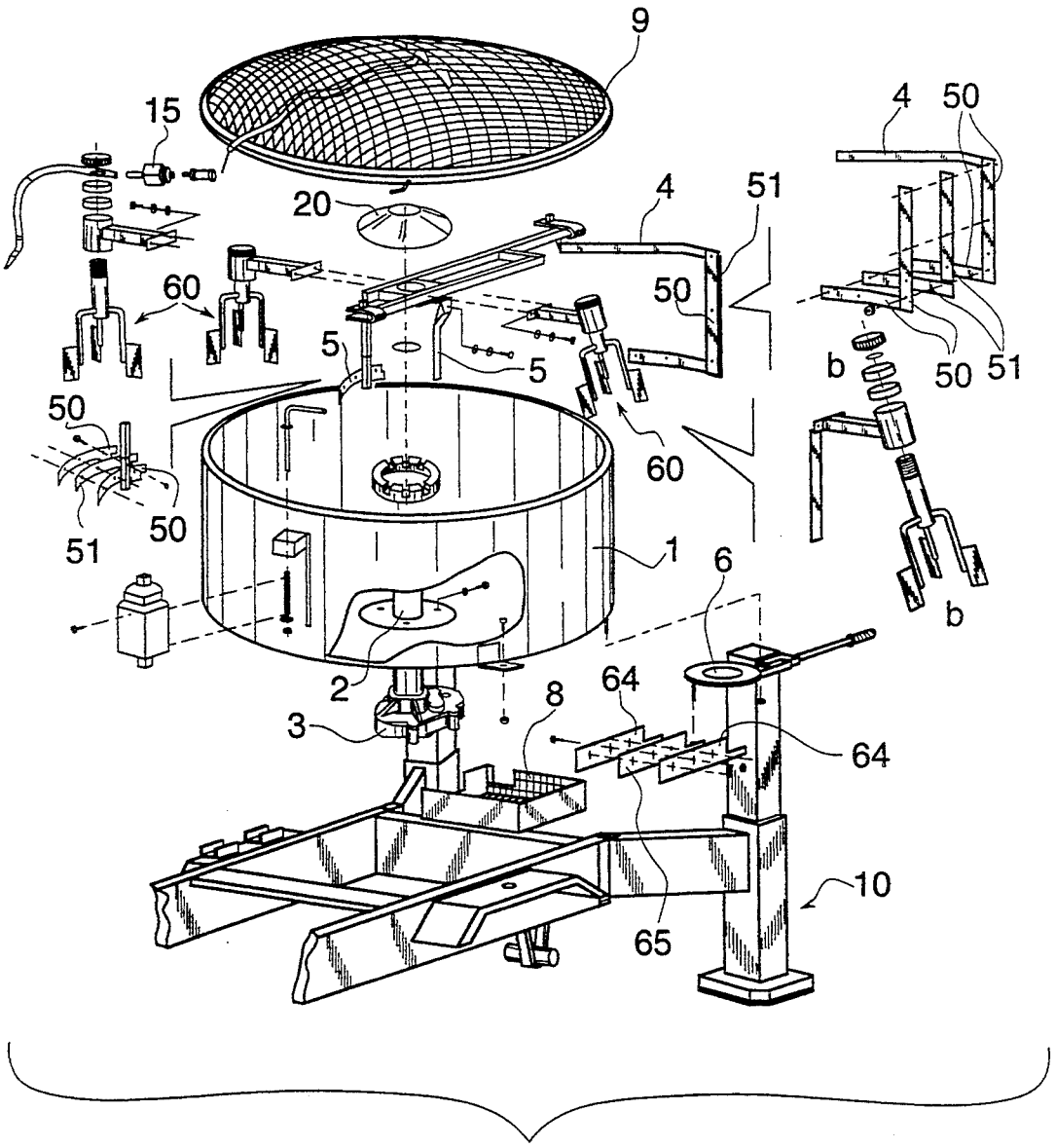
FIG. 9 is an exploded perspective view of the mixer of FIG. 7.

Advantageously, according to the invention and with reference to FIGS. 7–9 of the attached drawings, in the case of mixers of the type having one or more groups of paddles (60) rotating about an axis transverse to the relevant support arm (40), the axis of rotation (b—b) (see FIG. 9) of the paddles (60) of at least one of these groups is inclined with respect to the horizontal plane, and the respective paddles (60) are shaped, that is, curved, with spiral development about the axis (b—b). This being of further aid in achieving the correct mixing of the materials introuced inside the drum (1).

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

What is claimed is:

1. A paddle mixer, comprising: a support frame; a stationary drum rigidly connected to said support frame; a vertical shaft extending into said stationary drum; a motor-reducing unit connected to said vertical shaft; a plurality of transverse arms connected to said vertical shaft within said stationary drum; a paddle connected to each of said transverse arms, said drum having a discharge mouth; a horizontal gate provided in a bottom of said drum, said horizontal gate for opening and closing said discharge mouth; a lever connected to said horizontal gate for manually moving said gate between an open position and a closed position; a protective grate disposed below said horizontal gate, said protective grate being connected to said drum; electrical power means, including a control unit for controlling said motor-reducer unit, said paddles including fixed paddles, fixedly connected to a corresponding one of said plurality of transverse arms, each of said fixed paddles including two plates, of substantially the same dimension, said two plates being disposed at a free end of said corresponding arm and a rubber element interposed between said two plates, whereby upon rotation of said vertical shaft, the rubber elements scrape one of a side and the bottom of said stationary drum.

2. A paddle mixer, according to claim 1, wherein said paddles include a paddle rotatively connected to one of said plurality of transverse arms.

3. A paddle mixer, according to claim 2, wherein said rotating paddles include an axis of rotation which is inclined with respect to a horizontal plane and said rotatable paddles are shaped to have a helically-curved surface.

4. A paddle mixer, according to claim 1, wherein said stationary drum includes an upper open end defining a loading mouth, a second grate being disposed above said loading mouth and positioned coaxial thereto; a horizontal pivot connecting an outer side wall of said drum to said second grate; a fork-like bracket rigidly connected to said second grate, said fork-like bracket connecting said second grate to said horizontal pivot, whereby said grate rotates about an axis of said pivot; a handle fixed to said second grate on a side of said second grate opposite to said pivot; an annular cam coupled to said pivot; a vertically sliding switch including electrical contacts connected to said motor-reducer unit said sliding switch being acted on by said cam to open said electrical contacts, whereby said motor-reducer unit is powered off upon an operator lifting said second grate.

5. A paddle mixer, according to claim 1, wherein said vertical shaft is provided with a top with a substantially truncated-cone-shaped element, said cone-shaped element being coaxial to said vertical shaft; a pipe for the admission of a liquid into said stationary drum, said pipe having a discharge end positioned above said cone-shaped element whereby liquid introduced into said pipe is spread by said cone-shaped element, in a rain-like fashion, over material within said stationary drum.

6. A paddle mixer, according to claim 1, wherein said horizontal gate is formed of two horizontal facing coaxial plates with an annular rubber gasket positioned therebetween, screw means for joining said two horizontal facing coaxial plates together, a fork-like bracket connected to said lever on a side of said lever opposite to a lever handle; a gate-bearing member including a counteracting spring having a vertical axis, said gate-bearing member being supported by said fork-like bracket for allowing upwardly directed elastic compression of said horizontal gate against a lower edge of said discharge mouth of said drum.

7. A paddle mixer, according to claim 1, further comprising a gate paddle including a plate construction formed of two plates with a rubber element interposed therebetween, said gate paddle being provided at a bottom of said horizontal gate whereby said gate paddle scrapes a lower surface of said grate, whenever said horizontal gate is operated.

8. A paddle mixer, according to claim 1, wherein said support frame includes damper means for absorbing shocks during movement of said support frame.

9. A paddle mixer, according to claim 1, wherein said frame includes a lifting jack to adjust a position of said stationary drum.

* * * * *